US010378234B1

(12) United States Patent
Nielsen et al.

(10) Patent No.: US 10,378,234 B1
(45) Date of Patent: Aug. 13, 2019

(54) COMPACT, COLLAPSIBLE AWNING SYSTEMS FOR ALL-TERRAIN VEHICLES

(71) Applicant: KCNFP, LLC., Pleasant Grove, UT (US)

(72) Inventors: Kenneth Craig Nielsen, Pleasant Grove, UT (US); Lynette Nielsen, Pleasant Grove, UT (US)

(73) Assignee: KCNFP, LLC., Pleasant Grove, UT (US)

( * ) Notice: Subject to any disclaimer, the term of this patent is extended or adjusted under 35 U.S.C. 154(b) by 0 days.

(21) Appl. No.: 15/944,096

(22) Filed: Apr. 3, 2018

(51) Int. Cl.

| | |
|---|---|
| ***E04H 15/06*** | (2006.01) |
| ***E04H 15/32*** | (2006.01) |
| ***E04H 15/64*** | (2006.01) |
| *E04H 15/62* | (2006.01) |
| *E04H 15/60* | (2006.01) |

(52) U.S. Cl.
CPC ..... *E04H 15/06* (2013.01); *E04H 15/32* (2013.01); *E04H 15/64* (2013.01); *E04H 15/60* (2013.01); *E04H 15/62* (2013.01)

(58) Field of Classification Search
CPC ..... E04H 15/06; E04H 15/08; E04H 15/32
USPC ..... 135/126
See application file for complete search history.

(56) References Cited

U.S. PATENT DOCUMENTS 2,315,680 A * 4/1943 Ward ..... E04H 15/06 135/119
2,720,885 A * 10/1955 Legg ..... B60P 3/343 135/120.3
2,788,791 A * 4/1957 Pospisil ..... E04H 15/06 135/161
2,967,532 A * 1/1961 Burgin ..... E04H 15/06 135/151
3,327,724 A * 6/1967 Nielsen ..... E04F 10/0648 135/118
4,191,418 A * 3/1980 Ladegast, Jr. ..... B60P 3/343 135/117
5,400,813 A 3/1995 Swan, Jr.
5,676,414 A * 10/1997 Hammond ..... B60J 1/2011 296/165
6,050,280 A * 4/2000 Jeske ..... E04H 15/08 135/115
6,439,645 B1 8/2002 Pedersen
6,796,359 B1 * 9/2004 Knutson ..... E04F 10/04 135/88.12
6,802,327 B2 10/2004 Koss
6,997,497 B2 2/2006 Sagi et al.
(Continued)

*Primary Examiner* — Noah Chandler Hawk
(74) *Attorney, Agent, or Firm* — Workman Nydegger

(57) ABSTRACT

Kits for retrofitting an all-terrain vehicle with a compact, collapsible awning system include a collapsible canopy having a plurality of securing elements, an attachment mechanism having a first end coupled to a first side of the canopy and a detachable second end, a pole configured to associate with any of the plurality of securing elements and to support the canopy, and a tie-down configured to associate with any of the plurality of securing elements and to extend the canopy such that when combined with at least the pole, the canopy forms an overhead structure. The second detachable end of the attachment mechanism can be associated with a connection point on the all-terrain vehicle, and when extended the awning can form an overhead shelter adjacent to the all-terrain vehicle, providing shade and/or temporary protection from the elements.

19 Claims, 4 Drawing Sheets

(56) References Cited

U.S. PATENT DOCUMENTS

| | | | | |
|---|---|---|---|---|
| 7,108,005 | B1 * | 9/2006 | Christenson | E04H 15/06 135/88.05 |
| 8,281,795 | B2 | 10/2012 | Cutler | |
| 8,596,451 | B2 * | 12/2013 | Merritt | E04H 9/028 206/223 |
| 8,708,027 | B2 * | 4/2014 | Howie | E04H 15/06 160/368.1 |
| 2003/0230329 | A1 * | 12/2003 | McGarty | E04H 15/06 135/88.07 |
| 2006/0107983 | A1 | 5/2006 | Froncek | |

* cited by examiner

COMPACT, COLLAPSIBLE AWNING SYSTEMS FOR ALL-TERRAIN VEHICLES

BACKGROUND

Technical Field

This disclosure generally relates to recreational vehicles. More specifically, the present disclosure relates to portable shelters for use with all-terrain vehicles.

Related Technology

All-terrain vehicles (ATVs) are small motorized vehicles adapted for use in wilderness settings and allow riders to explore rugged or undeveloped terrain. Many ATVs are designed for single riders. This can create problems if a potential rider lacks the experience or desire to operate the machine but nonetheless wishes to accompany another rider. Some ATVs are large enough to allow for a passenger to piggyback the rider. However, this can make operation of the machine more dangerous and/or difficult.

Side-by-side ATVs offer a safer, convenient, and more conventional alternative for individuals who do not feel comfortable or who are incapable of operating an ATV but nonetheless wish to embark on ATV-based outings, allowing them to ride along as passengers. Further, side-by-side ATVs are particularly beneficial for accommodating passengers with limited mobility or physical handicaps. They offer a conventional seat and restraint system and are commonly configured to include additional protective features, such as roll bars and a cloth or hard top roof to provide shade and UV protection when recreating in sunny conditions.

However, such roofs often fail to provide sufficient shade or shelter from the elements, particularly during prolonged breaks when an overhead shelter is most desirable.

Accordingly, there are a number of disadvantages with recreational vehicles that can be addressed.

BRIEF SUMMARY

Implementations of the present disclosure solve one or more of the foregoing or other problems in the art with recreational vehicles. In particular, one or more implementations can include an awning system having (i) a collapsible canopy that includes a plurality of securing elements, (ii) an attachment mechanism having a first end coupled to a first side of the canopy and a detachable second end, (iii) a pole configured to associate with any of the plurality of securing elements and to support the canopy, and a tie-down configured to associate with any of the plurality of securing elements and to extend the canopy such that when combined with at least the pole, the canopy forms an overhead structure.

The detachable second end of the attachment mechanism can be associated with a connection point on an ATV, preferably a side-by-side ATV. Additionally, the disclosed awning systems can include a storage bag sized and shaped to at least partially surround the collapsible canopy, the pole, and the tie-down. A first side of the storage bag can define an aperture that is sized and shaped to allow transit of the first end of the attachment mechanism therethrough, thereby allowing the canopy to be connected to the ATV through the storage bag.

The present disclosure also includes kits for retrofitting an ATV with a compact, collapsible awning system. An exemplary kit can include a collapsible canopy having a central region, a first wing region, a second wing region, and a plurality of grommets. The first wing region can be disposed on an opposite side of the central region as the second wing region, and the plurality of grommets can be disposed on a peripheral edge of the canopy. The kit can additionally include two or more attachment mechanisms with each attachment mechanism having a first end coupled to a first side of the collapsible canopy and a detachable second end comprising a loop. The kit can additionally include a storage bag sized and shaped to at least partially surround the collapsible canopy when the collapsible canopy is in a collapsed configuration. The storage bag can include at least two apertures defined by a first side of the storage bag with each of the apertures being sized and shaped to allow transit of a corresponding attachment mechanism therethrough.

Accordingly, awning systems and kits for retrofitting an ATV with a compact, collapsible awning system are disclosed.

This summary is provided to introduce a selection of concepts in a simplified form that are further described below in the detailed description. This summary is not intended to identify key features or essential features of the claimed subject matter, nor is it intended to be used as an indication of the scope of the claimed subject matter.

Additional features and advantages of the disclosure will be set forth in the description which follows, and in part will be obvious from the description, or may be learned by the practice of the disclosure. The features and advantages of the disclosure may be realized and obtained by means of the instruments and combinations particularly pointed out in the appended claims. These and other features of the present disclosure will become more fully apparent from the following description and appended claims or may be learned by the practice of the disclosure as set forth hereinafter.

BRIEF DESCRIPTION OF THE DRAWINGS

In order to describe the manner in which the above recited and other advantages and features of the disclosure can be obtained, a more particular description of the disclosure briefly described above will be rendered by reference to specific embodiments thereof, which are illustrated in the appended drawings. It is appreciated that these drawings depict only typical embodiments of the disclosure and are not therefore to be considered to be limiting of its scope. The disclosure will be described and explained with additional specificity and detail through the use of the accompanying drawings in which.

DETAILED DESCRIPTION

Figure 1:
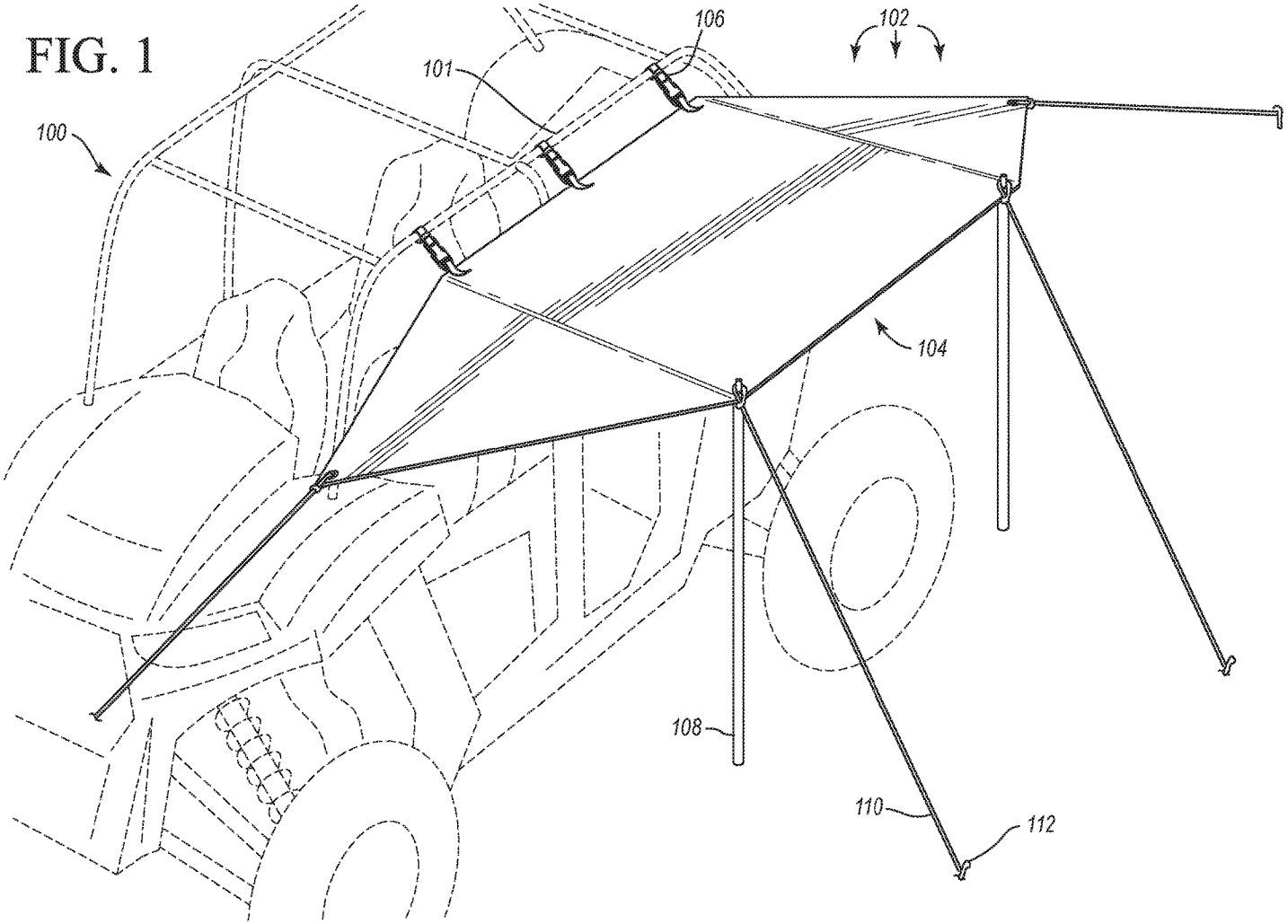
FIG. 1 illustrates an exemplary awning system in association with a side-by-side ATV in accordance with the present disclosure.

Before describing various embodiments of the present disclosure in detail, it is to be understood that this disclosure is not limited to the parameters of the particularly exemplified systems, methods, apparatus, products, processes, and/or kits, which may, of course, vary. Thus, while certain embodiments of the present disclosure will be described in detail, with reference to specific configurations, parameters, components, elements, etc., the descriptions are illustrative and are not to be construed as limiting the scope of the claimed invention. In addition, the terminology used herein is for the purpose of describing the embodiments and is not necessarily intended to limit the scope of the claimed invention.

Overview of Disclosed Awning Systems for All-Terrain Vehicles

As noted above, side-by-side ATVs are particularly beneficial for accommodating passengers with limited mobility or physical handicaps. They offer a conventional seat and restraint system and are commonly configured to include additional protective features, such as roll bars and a cloth or hard top roof to provide shade and UV protection when recreating in sunny conditions. However, such roofs often fail to provide sufficient shade or shelter from the elements, particularly during prolonged breaks when an overhead shelter is most desirable. ATVs, particularly side-by-side ATVs stand in need of systems for providing additional, on-demand shade or shelter in a convenient and portable manner.

Awnings are one type of structure that provides an overhead shelter, typically to a building or gathering spot. For example, awnings are commonly associated with the edifice of a building at or above an entryway and extend some distance away from the building to provide shelter to those who are entering or exiting the building. The awning, itself, can be made of a wide range of materials, from metal and glass to wood, canvas, or tarp and are particularly useful when designed to provide shade or temporary reprieve from the elements. Most awnings, however, are static objects fixed in a desired location and are of limited utility with respect to an ATV.

Similarly, retractable awnings associated with select mobile homes and recreation trailers are of limited utility for an ATV. Such retractable awnings typically include two pivoting arms coupled to a sidewall of the mobile home/recreation trailer that pivot in a radial fashion away from the sidewall to extend a fabric or canvas canopy. As with traditional building-associated awnings, retractable awnings are fixed to the structure and fail to offer the versatility and compactness desired for an off-road vehicle. After all, most ATVs lack considerable storage space, and due to the off-road, rugged uses to which they are put, ATVs are not suited to convey prior art retractable awnings without damaging or destroying them—and thereby diminishing their utility. Accordingly, there is a need for portable awning systems that can be easily used in the field, particularly for use with ATVs, which are collapsible and compact when stored, and which can be selectively attached or removed from the vehicle in little time and with little effort.

The portable awning systems of the present disclosure can be quickly and easily secured to an attachment point on an ATV and extended to form an overhead shelter, providing shade and/or protection from the elements. For example, an awning system can include a canopy that forms the overhead, protective component of the awning system. The canopy can be secured to the ATV at a first end by attachment mechanisms and supported by poles and tie-downs at a second end. In some of the disclosed embodiments, the awning system can additionally include a storage bag configured in size and shape to hold the collapsed canopy and poles, in addition to any other equipment associated with the awning system (e.g., anchors, tie downs, canopy repair supplies, etc.). The bag can additionally include or define a plurality of apertures through which the attachment mechanisms of the canopy are secured to the ATV and a closing mechanism for retaining the contents of the bag within the confines defined thereby. By securing the disclosed awning systems to vehicle in this way, it is possible to quickly and easily attach and detached the awning system from the ATV without disrupting the contents of the storage bag.

Further, upon attaching/re-attaching the storage bag to the vehicle, the user is, in essence, attaching/reattaching the canopy to the vehicle. Thus, when the storage bag is opened and the canopy is extended, the first end of the canopy is already attached to the vehicle. The second end simply needs to be supported by the included poles and optionally anchored with tie-downs and stakes to complete the awning assembly. Such ease of use and intentional storage configuration beneficially reduces the amount of time and energy necessary to associate an awning with an ATV—whether in the field or at base camp—and solves at least some of the aforementioned problems associated with portable shelters for use with ATVs.

The portability and ease of use offered by the disclosed awning systems additionally enable—within minutes—the retrofitting of existing ATVs with a compact, collapsible awning system without significantly increasing the footprint or weight distribution of the vehicle. Also, the attachment process advantageously does not require specialized tools or permanent affixation of awning components, improving the portability and versatility of awning systems for use with ATVs. For example, disclosed awning systems can be relocated to a storage location during transit or non-use, dirty awnings can be removed quickly and easily for cleaning, and damaged awnings can be swapped for functional ones in seconds—all without professional oversight or specialized tools.

Exemplary Awning Systems and Kits Including the Same

The disclosed awning systems are preferably for use with ATVs and more preferably for use with side-by-side ATVs. FIG. 1 illustrates an exemplary side-by-side ATV 100 having an assembled awning system 102 associated therewith. The component parts of the illustrated awning system of FIG. 1 are provided in FIG. 2 in an unassembled component form. For the ease of illustration, a storage bag for storing and transporting the disclosed compact awning systems is omitted from FIG. 1, but it should be appreciated that in some embodiments, the assembled awning system 102 of FIG. 1 can additionally include a storage bag, similar to that shown in FIGS. 2 and 3.

Referring now to FIG. 1, the awning system 102, as shown, includes a canopy 104 secured to the ATV 100 at a top member 101 of the roll bar by an attachment mechanism 106. It should be appreciated that the attachment point for the attachment mechanism 106 can be, or include, other components of the ATV 100 aside from the top member of the roll bar. Any suitable attachment point can be chosen at the discretion of the user and can in some embodiments change the use or implementation of the awning.

For example, in one embodiment, the awning system is attached to the body of the ATV, providing a low overhead structure suitable for sitting, kneeling, or lying beneath. Alternatively, the awning system can be attached to the undercarriage or running boards and extended outwardly from the ATV to provide a sitting area (e.g., for a picnic or as a barrier between sodden or muddy terrain). While different attachment points offer varied uses for the disclosed awning systems, a preferred embodiment for the disclosed awning systems is as a compact, collapsible overhead awning attached to the roll bar of the ATV, as shown in FIG. 1.

Figure 2:
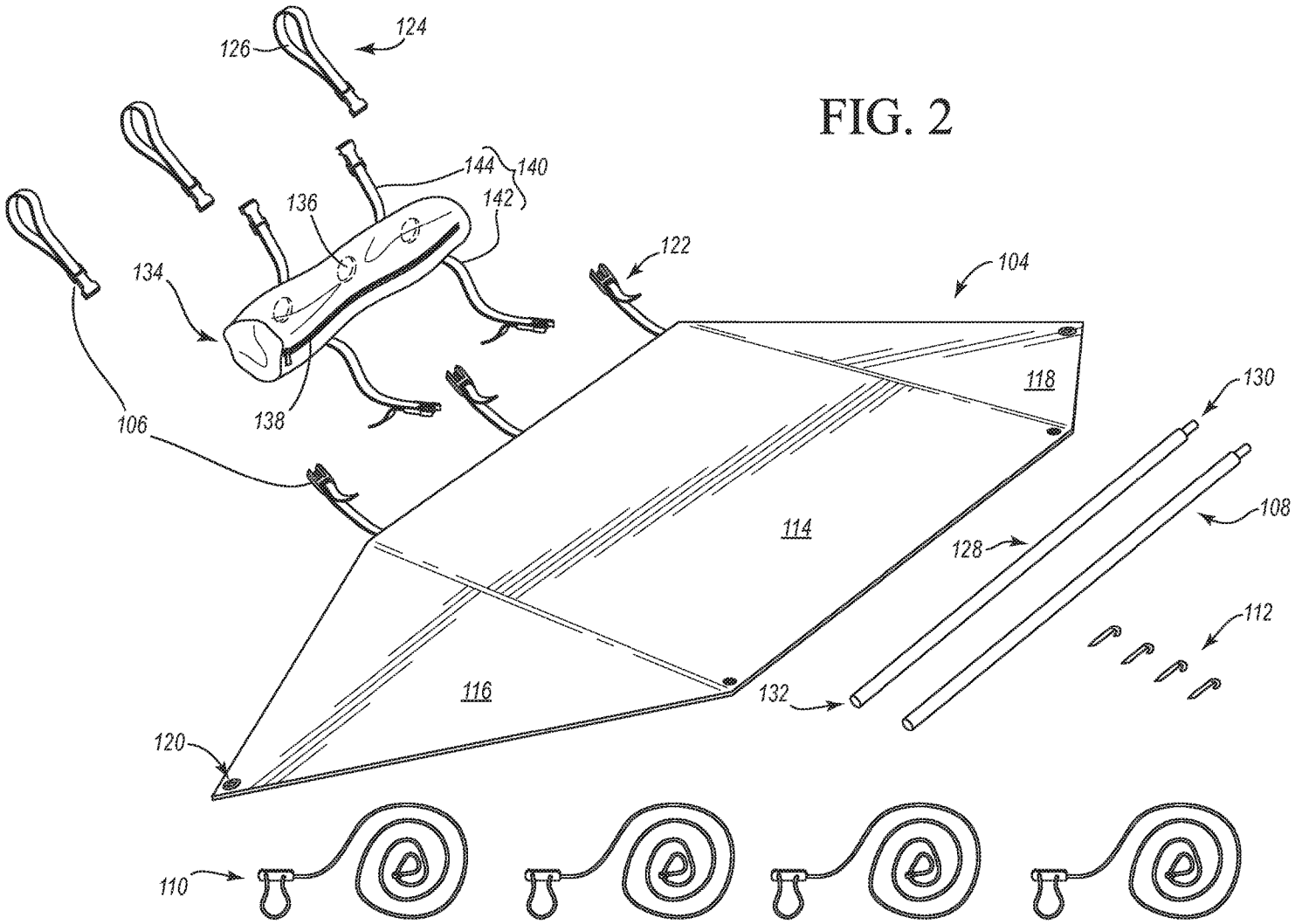
FIG. 2 illustrates components of an exemplary awning system, as could be included within a compact, collapsible awning kit for use with ATVs in accordance with the present disclosure.

With continued reference to FIGS. 1 and 2, the awning system 102 additionally includes a pair of poles 108, a plurality of tie-downs 110, and stakes 112 for expanding, tightening, and/or securing the canopy 104 in an open configuration. The poles 108 can be rigid poles of a predefined height such that when positioned orthogonal to a flat surface, the poles extend to substantially the same height as the attachment point of the canopy on the ATV 100. In some embodiments, the poles 108 are telescoping poles that have an adjustable height, which can be beneficial when accommodating uneven terrain or varied preference for the height of the canopy 104. Telescoping poles additionally provide the advantage of being more compact and less burdensome to pack.

In some embodiments, the poles are the longest component of the awning system, and consequently, the length of the storage bag can be dependent upon the length of the poles. Telescoping poles can beneficially telescope down to enable a desirable compact size for packing while still allowing the poles to extend to variable heights greater than the compacted height of the pole. The poles can telescope as a series of concentrically smaller poles or as a single smaller diameter section that extends to variable predefined heights marked by small apertures that accept a depressible locking pin. In some instances, the telescoping pole includes a series of tapered inset sections where for each non-terminal section, the proximal diameter is substantially the same diameter as the distal diameter of the adjacent, larger section. Other types of telescoping poles can be used, as known in the art.

While the awning systems 102 of FIGS. 1 and 2 illustrate a pair of poles 108, it should be appreciated that awning systems 102 can include any number of rigid or telescoping poles. For example, an awning system may include four poles configured to associate with the canopy at four different locations. Alternatively, an awning system could include one pole, three poles, or more than four poles, depending on the size of the canopy and the desired structural support.

As shown in FIG. 1, the poles 108 and/or the canopy 104 can be supported by a number of tie-downs 110. The tie-downs 110 associated with the awning system 102 can include any suitable tie-down, including a cord, rope, chain, strap, ratchet straps, cam straps, or other tie-down configured to associate with the canopy 104 or poles 108 at a first end and with an anchor at a second end. In some embodiments, the anchor is a real-world object such as a rock or tree, but the anchor can additionally, or alternatively, be a component of the awning system 102. For example, as shown in FIGS. 1 and 2, the anchor can include stakes 112. The stakes 112 can be made of or include any suitable material and can take any shape configured to anchor a tie-down 110 (e.g., having a bent or hook-shaped end as shown in FIG. 2).

The aforementioned tie-downs 110 and stakes 112 (or other anchor) generally serve to extend and secure the canopy 104. The canopy 104 is illustrated as a trapezoidal shape having a generally rectangular central region 114 flanked on opposing sides by triangular wings 116, 118. The shape of the canopy 114 illustrated in FIGS. 1 and 2 is exemplary in nature, and it should be appreciated that the canopy 114 can be any shape that would provide shade or protection from the elements when attached to and extended away from the ATV 100. Further, the canopy 114 can be made of or include any collapsible material, such as cloth, natural or synthetic fabric, canvas, or tarpaulin.

The canopy 114 can additionally incorporate a number of securing elements 120 configured to enable the poles 108 or tie-downs 110 to be secured to the canopy 104. As illustrated in FIGS. 1 and 2, the securing elements 120 are grommets. The grommets permit a pointed or narrow head 130 of the pole 108 to extend through the aperture formed thereby and allow tension to be applied to the canopy 104 at the site of the grommet without tearing the canopy 104. Additionally, a looped tie-down 110 can be secured to the grommet at one end and an anchor at an opposing end, and the grommet can resist or prevent tearing of the canopy 104 due to the tension applied to the canopy 104 by the tie-down 110 and anchor. In some embodiments, the tie-down includes a hook that can be easily and quickly attached to the grommet (or other securing element 120) to further reduce the time taken to set up and disassemble the awning system 102.

As described above, with the canopy 104 secured to the ATV 100 at a first end, the poles 108, tie-downs 110, and/or anchors can extend the canopy to form a structure that provides protection from the elements (e.g., as an overhead structure providing shade). The canopy 104 is associated with the ATV 100 at an attachment site 101, preferably the top member of a roll bar, using an attachment mechanism 106.

The term "attachment mechanism," as used herein, includes any device in one or more pieces that may be used to "attach" two or more components or to "attach" one component to another component. The term "attach" and/or "attachment" may refer to its common dictionary definition where appropriate, but it may contextually refer to particular acts of connecting, associating, affixing, fastening, sticking, joining, or any combination of the foregoing that cause an object to be fixedly or selectively proximate another object. In some embodiments, the attachment mechanism may be an integral part of a component, whereas in other embodiments, the attachment mechanism may be separate.

An attachment mechanism is to be understood to have any number of movable and/or fixed parts, any of which may be singularly or in combination with one or more components interact to facilitate attachment. As non-limiting examples, an attachment mechanism may include a mechanism for attaching components using one or more—or a combination of—mechanical fasteners (e.g., quick-release clips, buckles, threaded fasteners such as a combination of a threaded rod together with a complementary threaded nut, rivets, screws, clamps, tenon and mortise pairs, hook and loop fasteners, dual lock reclosable fasteners, cable ties, hooked bungee cords, rubber bands, etc.), magnets, vacuums (e.g., suction cups, etc.), and/or interference fittings (e.g., press fittings, friction fittings, etc.). Additionally, or alternatively, an attachment mechanism may include any material or element resulting from physically attaching two or more components by crimping, welding, and/or soldering or from attaching two or more components using chemical adhesives (e.g., an epoxy and/or other thermosetting adhesives, glue, cement, paste, tape and/or other pressure-sensitive adhesives, etc.).

As used herein, the term "attachment mechanism" is often used in reference to the quick-release clips illustrated in the figures but should be understood to represent an exemplary, if preferred, embodiment of an attachment mechanism without necessarily excluding the foregoing alternatives. That is, while embodiments that allow for a removable awning system may be preferred (and therefore, attachment mechanisms that enable the selective attachment of awning systems to an ATV are similarly preferred), the awning systems disclosed herein could alternatively be fixedly coupled or otherwise integrated into the ATV using any of the disclosed attachment mechanisms that enable fixed attachments. As a non-limiting example, the attachment mechanisms could include rivets that fixedly couple the canopy of an awning system to an ATV. In such an embodiment, some of the previously noted advantages of a detachable awning system may be limited. However, other advantages, such as the ability to provide on-demand overhead shelter to individuals recreating in an ATV, remain intact and allow for an easy, portable solution for outdoor adventurers in search of shade or temporary reprieve from the elements.

Referring again to FIG. 2, the attachment mechanism 106 can include a first end 122 and a detachable second end 124. The first end 122 and second end 124 include complementary portions of a quick-release clip. In one embodiment, the detachable second end can include a loop 126 that can be used to quickly attach/detach the detachable second end 124 to the attachment site 101 (e.g., wrapping the detachable second end 124 around the top member of a roll bar, passing the quick-release portion through the loop, and cinching the detachable second end into a tight association with the roll bar). The complementary quick-release clip portion disposed on the first end 122 of the attachment mechanism 106 can then be secured to the detachable second end 122, thereby attaching the canopy 104 to the attachment site 101.

Figure 3:
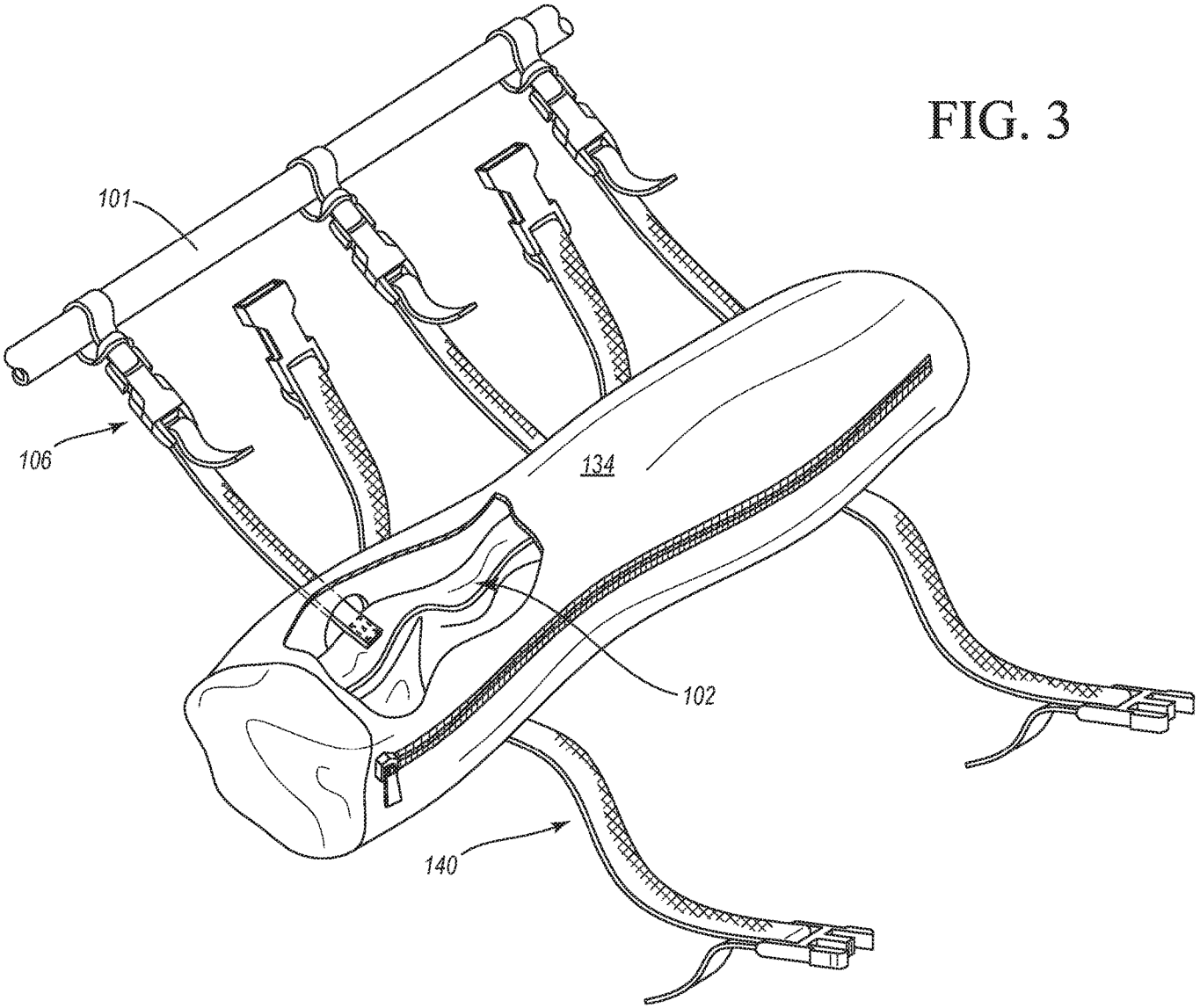
FIG. 3 illustrates the awning system of FIG. 2 packed within a storage bag and associated with an attachment site of an ATV in accordance with the present disclosure.

In embodiments where a storage bag 134 is used, such as that illustrated in FIG. 3, the first end 122 of the attachment mechanism 106 can pass through apertures 136 formed by the storage bag 138 before coupling with the second end 124. Doing so disposes the storage bag 134 between the attachment site 101 and the canopy 104. When it is desirous to store the awning system 102, the canopy 104 can be collapsed and folded or stuffed into the storage bag 134 along with the (collapsed) poles 108, tie-downs 110, and stakes 112. That is, in some embodiments, the storage bag 134 is sized and shaped to fit at least the canopy 104 and any of the poles 108, tie-downs 110, stakes 112, and/or other components of the awning system 102—as shown in FIG. 3. A closing mechanism 138 on the bag can seal the awning system components therein and allow for portability and compact storage thereof. This is particularly advantageous when the first ends 122 of the attachment mechanism 106 are attached to the second ends 124 through the apertures 136 in the storage bag 134.

For example, the storage bag 134 containing the awning system components can be stored away from the attachment site 101 while the ATV is in use and quickly reattached when desired. Such configuration additionally allows the awning system components to be removed for cleaning, replacement, or repair without the use of specialized tools or considerable labor.

In some embodiments, the storage bag 134 can remain associated with the attachment site 101 during use or transport of the ATV 100 by a carrier vehicle. The attachment mechanisms 106 are, under most circumstances, sufficient to safely retain the storage bag 134 and awning system components associated with the ATV. The storage bag 134 can additionally include securing members 140 configured to further secure the storage bag 134 to the attachment site 101. For example, the securing member 140 can be a quick-release clip; a first end 142 of the securing member 140 can attach to its complementary second end 144 after the second end is pass around, for example, the roll bar of the ATV. In some embodiments, the securing member 140 can be used to secure the storage bag 134 to a location apart from the attachment site 101. This can include, for example, securing the storage bag 134 to a front or rear "trunk" portion of the ATV or to allow the storage bag 134 to be hung from a hook (or similar) during long term storage.

In some embodiments, the securing member 140 is wrapped around the storage bag 134, itself, to prevent the awning components contained therein from shifting or to make the storage bag 134 more compact. The first and/or second end of the securing member 140 can include an adjustable-length strap to allow the securing member to be cinched tight to form a tight association between the storage bag 134 and a storage site, the attachment site 101, or even to itself (i.e., when making the storage bag 134 more compact).

Figure 4B:
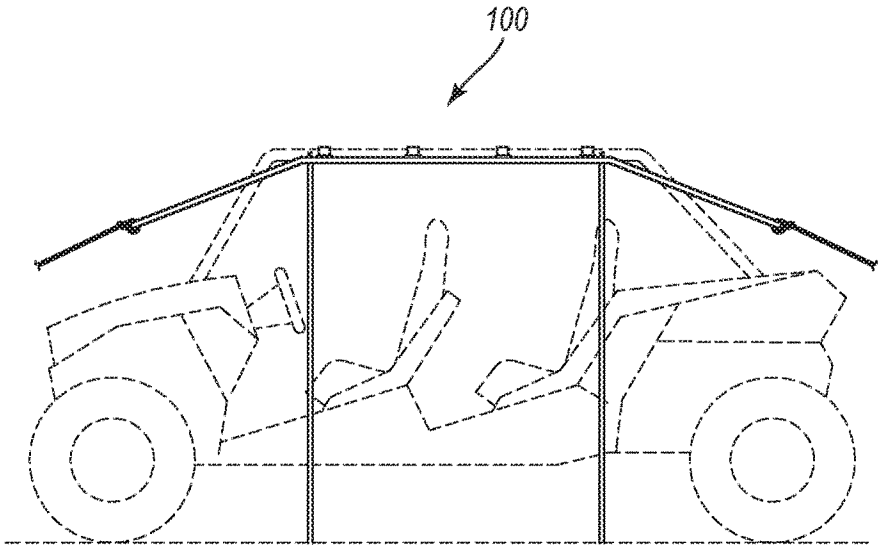
FIG. 4B illustrates another exemplary awning system, depicted in association with a side-by-side ATV having four seats.
Figure 4A:
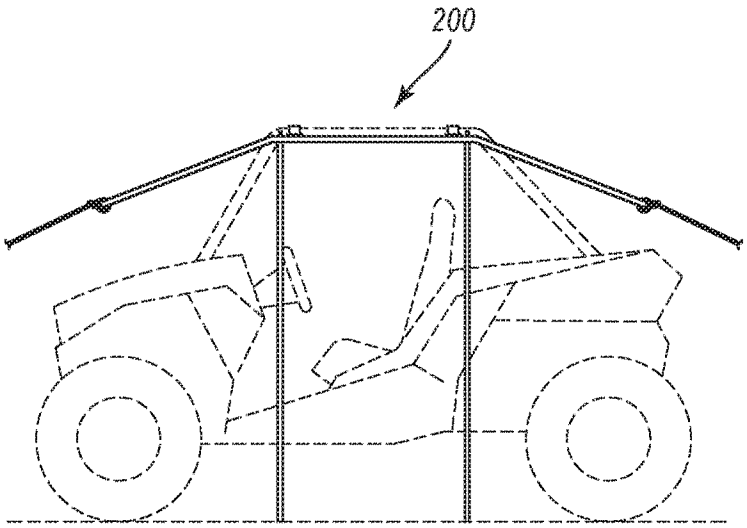
FIG. 4A illustrates an exemplary awning system, depicted in association with a side-by-side ATV having two seats.

It should be appreciated that the awning systems disclosed herein can be sized and shaped to accommodate differently sized ATVs. For example, as shown in FIG. 4A, the awning system 200 can be sized to fit a two-seater side-by-side ATV. Alternatively, as shown in FIG. 4B, the awning system 300 can be sized and shaped for a four-seater side-by-side ATV; such an awning system 300 can include four attachment mechanisms, as shown. In an exemplary embodiment, the awning system 100 illustrated and discussed with respect to FIGS. 1-3 can be adapted for use with a two-seater and/or four-seater side-by-side ATV. As illustrated in FIGS. 4A and 4B, sizing the awning system to accommodate differently sized ATVs can result in fewer or greater components, such as fewer or greater attachment mechanisms.

As shown, the awning system in FIG. 4A includes two attachment mechanisms, whereas the awning system in FIG. 4B includes four attachment mechanisms. The number of attachment mechanisms can correspond, in some embodiments, to a length of the central portion of the canopy. Additionally, or alternatively, the number and/or placement of apertures on the storage bag can correspond to the placement of the first end of the attachment mechanism on the canopy. In some embodiments, the storage bag includes three apertures equally spaced apart and can be used for the awning systems of FIGS. 1-3.

Alternatively, a storage bag can include two apertures—one at each end—and can be used for the awning system of FIG. 4A that includes two attachment mechanisms. In some embodiments, the same storage bag (having two apertures) can be used with the awning system 300 of FIG. 4B or the awning system 102 of FIGS. 1-3. The attachment mechanisms not directly aligned with an aperture can be omitted from use or can, alternatively, be positioned through a nearest aperture in the bag to connect to the second detachable end anchored to the ATV. It should be appreciated that other components of the awning system can be similarly sized up or down to accommodate differently sized ATVs and/or differently sized components of the awning system.

CONCLUSION

Unless defined otherwise, all technical and scientific terms used herein have the same meaning as commonly understood by one of ordinary skill in the art to which the present disclosure pertains.

Any headings used herein are for organizational purposes only and are not meant to be used to limit the scope of the description or the claims.

Various aspects of the present disclosure, including devices, systems, and methods may be illustrated with reference to one or more embodiments or implementations, which are exemplary in nature. As used herein, the term "exemplary" means "serving as an example, instance, or illustration," and should not necessarily be construed as preferred or advantageous over other embodiments disclosed herein. In addition, reference to an "implementation" of the present disclosure or invention includes a specific reference to one or more embodiments thereof, and vice versa, and is intended to provide illustrative examples without limiting the scope of the invention, which is indicated by the appended claims rather than by the following description.

As used throughout this application the words "can" and "may" are used in a permissive sense (i.e., meaning having the potential to), rather than the mandatory sense (i.e., meaning must). Additionally, the terms "including," "having," "involving," "containing," "characterized by," as well as variants thereof (e.g., "includes," "has," "involves," "contains," etc.), and similar terms as used herein, including within the claims, shall be inclusive and/or open-ended, shall have the same meaning as the word "comprising" and variants thereof (e.g., "comprise" and "comprises"), and do not exclude additional un-recited elements or method steps, illustratively.

Various alterations and/or modifications of the inventive features illustrated herein, and additional applications of the principles illustrated herein, which would occur to one skilled in the relevant art and having possession of this disclosure, can be made to the illustrated embodiments without departing from the spirit and scope of the invention as defined by the claims, and are to be considered within the scope of this disclosure. Thus, while various aspects and embodiments have been disclosed herein, other aspects and embodiments are contemplated. While a number of methods and components similar or equivalent to those described herein can be used to practice embodiments of the present disclosure, only certain components and methods are described herein.

It will also be appreciated that systems, devices, products, kits, methods, and/or processes, according to certain embodiments of the present disclosure may include, incorporate, or otherwise comprise properties, features (e.g., components, members, elements, parts, and/or portions) described in other embodiments disclosed and/or described herein. Accordingly, the various features of certain embodiments can be compatible with, combined with, included in, and/or incorporated into other embodiments of the present disclosure. Thus, disclosure of certain features relative to a specific embodiment of the present disclosure should not be construed as limiting application or inclusion of said features to the specific embodiment. Rather, it will be appreciated that other embodiments can also include said features, members, elements, parts, and/or portions without necessarily departing from the scope of the present disclosure.

Moreover, unless a feature is described as requiring another feature in combination therewith, any feature herein may be combined with any other feature of a same or different embodiment disclosed herein. Furthermore, various well-known aspects of illustrative systems, methods, apparatus, and the like are not described herein in particular detail in order to avoid obscuring aspects of the example embodiments. Such aspects are, however, also contemplated herein.

The present disclosure may be embodied in other specific forms without departing from its spirit or essential characteristics. The described embodiments are to be considered in all respects only as illustrative and not restrictive. The scope of the invention is, therefore, indicated by the appended claims rather than by the foregoing description. While certain embodiments and details have been included herein and in the attached disclosure for purposes of illustrating embodiments of the present disclosure, it will be apparent to those skilled in the art that various changes in the methods, products, devices, and apparatus disclosed herein may be made without departing from the scope of the disclosure or of the invention, which is defined in the appended claims. All changes which come within the meaning and range of equivalency of the claims are to be embraced within their scope.

What is claimed is:

1. An awning system, comprising:

a collapsible canopy having a plurality of securing elements;

a first attachment mechanism having a first end coupled to a first side of the canopy and a detachable second end;

a second attachment mechanism spaced apart from the first attachment mechanism by a distance and coupled to the first side of the canopy;

a pole configured to associate with any of the plurality of securing elements and to support the canopy;

a tie-down configured to associate with any of the plurality of securing elements and to extend the canopy such that when combined with at least the pole, the canopy forms an overhead structure; and a storage bag sized and shaped to at least partially surround one or more of the collapsible canopy, the pole, and the tie-down, wherein a first side of the storage bag defines a first aperture that is sized and shaped to allow transit of the first end of the attachment mechanism therethrough, and wherein the first side of the bag additionally defines at least a second aperture that is sized and shaped to allow transit of the second attachment mechanism therethrough, the second aperture being spaced apart from the first aperture by the distance between the first and second attachment mechanisms.

2. The awning system of claim 1, wherein the storage bag further comprises a plurality of securing members configured to secure the storage bag to an all-terrain vehicle or to make the storage bag more compact.

3. The awning system of claim 2, wherein a portion of each securing member is fixedly coupled to the first side of the storage bag.

4. The awning system of claim 1, wherein the storage bag further comprises:

a second side, the second side defining an opening in the storage bag; and a closing mechanism associated with the second side of the storage bag, the closing mechanism configured to at least partially close the opening.

5. The awning system of claim 4, wherein the storage bag further comprises a plurality of securing members configured to secure the storage bag to an all-terrain vehicle or to make the storage bag more compact, and wherein a portion of each securing member is fixedly coupled to the storage bag.

6. The awning system of claim 1, further comprising an anchor configured to associate with a portion of the tie-down and to selectively secure the portion of the tie-down at a location of the anchor.

7. The awning system of claim 1, wherein the second end of the attachment mechanism comprises a loop.

8. The awning system of claim 7, wherein the second end of the attachment mechanism is selectively associated with an attachment point on an all-terrain vehicle via the loop.

9. The awning system of claim 1, wherein the canopy further comprises a central region, a first wing region, and a second wing region, the first wing region being disposed on an opposite side of the central region than the second wing region.

10. The awning system of claim 9, wherein the plurality of securing elements comprises a plurality of grommets, the plurality of grommets being disposed on a peripheral edge of the canopy.

11. A kit for retrofitting a side-by-side ATV with a compact, collapsible awning system, comprising:

a collapsible canopy having a central region, a first wing region, a second wing region, and a plurality of grommets, the first wing region being disposed on an opposite side of the central region as the second wing region, and the plurality of grommets being disposed on a peripheral edge of the canopy;

two or more attachment mechanisms, each attachment mechanism having a first end coupled to a first side of the collapsible canopy and a detachable second end comprising a loop; and a storage bag sized and shaped to at least partially surround the collapsible canopy when the collapsible canopy is in a collapsed configuration, the storage bag having at least two apertures defined by a first side of the storage bag, each of the at least two apertures sized and shaped to allow transit of a corresponding attachment mechanism therethrough.

12. The kit as in claim 11, further comprising two or more telescoping poles configured to engage any of the plurality of grommets.

13. The kit as in claim 11, further comprising two or more tie-downs configured to engage any of the plurality of grommets or the two or more telescoping poles.

14. The kit as in claim 11, further comprising two or more anchors, wherein each anchor is configured to associate with and to selectively secure a portion of a corresponding tie-down.

15. The kit as in claim 11, further comprising a plurality of securing members, wherein a portion of each securing member is fixedly coupled to the storage bag.

16. An awning system, comprising:

a collapsible canopy having a plurality of securing elements;

an attachment mechanism having a first end coupled to a first side of the canopy and a detachable second end;

a pole configured to associate with any of the plurality of securing elements and to support the canopy;

a tie-down configured to associate with any of the plurality of securing elements and to extend the canopy such that when combined with at least the pole, the canopy forms an overhead structure; and a storage bag sized and shaped to at least partially surround one or more of the collapsible canopy, the pole, and the tie-down, wherein the storage bag further comprises a plurality of securing members configured to secure the storage bag to an all-terrain vehicle or to make the storage bag more compact.

17. The awning system of claim 16, wherein a portion of each securing member is fixedly coupled to a first side of the storage bag.

18. The awning system of claim 16, wherein the storage bag further comprises:

a second side, the second side defining an opening in the storage bag; and a closing mechanism associated with the second side of the storage bag, the closing mechanism configured to at least partially close the opening.

19. The awning system of claim 18, wherein the storage bag further comprises a plurality of securing members configured to secure the storage bag to an all-terrain vehicle or to make the storage bag more compact, and wherein a portion of each securing member is fixedly coupled to the storage bag.

* * * * *